US005095170A

United States Patent [19]

Chen et al.

[11] Patent Number: 5,095,170

[45] Date of Patent: Mar. 10, 1992

[54] INTERGRATED MEMBRANE PRE-EXTRACTION/SOLVENT EXTRACTION OF DISTILLATES

[75] Inventors: Tan-Jen Chen, Clearwater, Canada; James R. Sweet, Baton Rouge, La.

[73] Assignee: Exxon and Research and Engineering Company, Florham Park, N.J.

[21] Appl. No.: 622,443

[22] Filed: Dec. 5, 1990

[51] Int. Cl.[5] ..... C07C 7/00; C07C 7/144; C10G 21/16; B01D 11/00

[52] U.S. Cl. ..... 585/804; 585/818; 585/819; 585/857; 585/863; 585/864; 208/308; 208/327; 208/330; 208/335; 210/644; 210/650; 210/651

[58] Field of Search ..... 585/818, 819, 804, 857, 585/863, 864; 210/644, 650, 651; 208/308, 327, 330, 335

[56] References Cited

U.S. PATENT DOCUMENTS

| | | | |
|---|---|---|---|
| 2,930,754 | 3/1960 | Stuckey | 210/23 |
| 2,958,656 | 11/1960 | Stuckey | 210/23 |
| 3,244,763 | 4/1966 | Cahn | 260/677 |
| 3,370,102 | 2/1968 | Carpenter et al. | 260/674 |
| 4,115,465 | 9/1978 | Elfort et al. | 260/674 |
| 4,532,347 | 7/1985 | Vaughan | 562/528 |
| 4,670,151 | 6/1987 | Bitter et al. | 210/641 |
| 4,802,987 | 2/1989 | Black | 210/640 |
| 4,828,773 | 5/1989 | Feimer et al. | 264/45.5 |
| 4,837,054 | 6/1989 | Schucker | 427/244 |
| 4,861,628 | 8/1989 | Schucker | 427/245 |
| 4,879,044 | 11/1989 | Feimer et al. | 210/654 |
| 4,898,674 | 2/1990 | Pasternak et al. | 210/638 |
| 4,914,064 | 4/1990 | Schucker | 502/4 |
| 4,929,357 | 5/1990 | Schucker | 210/640 |
| 4,929,358 | 5/1990 | Koenitzer | 210/640 |
| 4,962,271 | 10/1990 | Black et al. | 585/819 |
| 4,966,707 | 10/1990 | Cussler et al. | 210/632 |

FOREIGN PATENT DOCUMENTS

| | | |
|---|---|---|
| 247585 | 12/1987 | European Pat. Off. . |
| 3059308 | 3/1988 | Japan . |
| 89/00444 | 7/1988 | PCT Int'l Appl. . |

OTHER PUBLICATIONS

"Dispersion-Free Solvent Extraction With Microporous Hollow Fiber Modules", Prasad, R., et al., AIChE Summer National Meeting, Boston, 1986.

"Microporous Membrane Solvent Extraction", Prasad, R., et al., Separation Science and Technology, 22(2&3) 619-640, 1987.

"Designing Hollow Fiber Contactors", Yang, M. C., et al., AIChE Journal, Nov. 1986, vol. 32, No. 11, pp. 1910-1916.

"Liquid-Liquid Extractions With Microporous Hollow Fibers", D'Elia, N. A., et al., J. Memb. Sci., 29(2986) 309-319.

"Critical Entry Pressure for Liquids in Hydrophobic Membranes", Kim, B. S., et al., J. Coll. & Interface Science, vol. 11, No. 1, Jan. 1987, pp. 1-8.

"Solvent Extraction with Microporous Hydrophilic and Composite Membranes", Prasad, R., et al., AIChE Journal, Jul. 1987, vol. 33, No. 7, pp. 1057-1066.

"Dispersion-Free Solvent Extraction with Microporous Hollow Fiber Modules", Prasad, R., et al., AIChE Journal, Feb. 1988, vol. 34, No. 2, 177-188.

"Nondispersive Solvent Extraction Using Microporous Membranes", Prasad, R., et al., AIChE Symposium Series, Membrane Materials & Processes, No. 261, vol. 84, 42-53.

"Hollow Fiber Solvent Extraction of Pharmaceutical Products: A Case Study", Prasad, R., et al., J. Memb. Sci., 47, (1989), 235-259.

"Novel Uses of Microporous Membranes: A Case Study", Callahan, R., AIChE Symposium Series, Membrane Materials & Processes, No. 261, vol. 84, 54-65.

*Primary Examiner*—Nhat Phan

*Attorney, Agent, or Firm*—Joseph J. Allocca

[57] ABSTRACT

The yield, raffinate product quality, and throughput of the selective solvent extraction of hydrocarbon feeds is improved by subjecting the hydrocarbon feeds from which aromatic hydrocarbons are to be selectively solvent extracted to a membrane separation process which selectively permeates aromatics through the membranes to produce a permeate rich in aromatics and a retentate rich in saturates and 1-ring aromatics and subjecting this retentate to the selective solvent extraction process.

7 Claims, 1 Drawing Sheet

INTERGRATED MEMBRANE PRE-EXTRACTION/SOLVENT EXTRACTION OF DISTILLATES

BACKGROUND OF THE INVENTION

1. Field of the Invention

The present invention is a process whereby yield, raffinate product quality, and throughput of the selective aromatics solvent extraction of hydrocarbons are improved by subjecting the hydrocarbon feed prior to the selective solvent extraction step to a membrane separation process whereby aromatic hydrocarbons are selectively removed from the feed by permeation through a membrane. Said selective membrane permeation step produces a permeate enriched in aromatics and a retentate of reduced aromatics content. Practice of the selective aromatics solvent extraction process on the retentate results in a higher yield of raffinate of higher quality and higher throughput as compared to the practice of the selective aromatics solvent extraction process on the raw hydrocarbon feed under the same extraction conditions (i.e., extraction severity).

The membrane separation process practiced can include any of the procedures for separating aromatic hydrocarbons from feed streams containing mixtures of aromatic and non-aromatic hydrocarbons. Such procedures include pervaporation, perstraction and membrane extraction processes.

2. Description of the Related Art

Removal of aromatic hydrocarbons from hydrocarbon feed streams such as fuels or lubes or specialty products (e.g. refrigerator, turbine, electrical insulating or white oils) is a commonly practiced process. This is so because the presence of aromatics in such hydrocarbon products is usually detrimental to their performance and commercial unacceptability.

Aromatic hydrocarbons in lube oil fractions have been associated with reduced viscosity indexes and poor stability to oxidation and light. For this reason it is generally beneficial to remove the aromatics.

Despite this generally accurate statement, however, it is equally true that not all aromatics are undesirable lube components or detrimental to performance or quality.

Poor oxidation and light stability is now associated with the polynuclear aromatic compounds, i.e. the multi-ring aromatics. Indeed, the presence of 1-ring aromatics in a lube oil fraction may be beneficial with regards to viscosity index and oxidation and light stability. One-ring aromatics which are heavily branched with alkyl side chains are now viewed as being desirable lube oil constituents.

The typical way to remove aromatic hydrocarbons from hydrocarbon feeds is by solvent extraction. In such a process the hydrocarbon feed is introduced into an extraction zone and contacted with a selective aromatic extraction solvent moving countercurrently. Typical aromatics extraction solvents include phenol, furfural, sulfolane, and N-methyl 2-pyrrolidone (NMP).

This process produces a raffinate rich in saturates and an extract lean in saturates and rich in aromatics present in the extraction solvent.

The raffinate is recovered for use as a lubes base stock while the extract, following solvent recovery to yield an extract oil may be further processed for specialty products or is used as cat cracker feed, burnt as fuel or sent to a coker.

U.S. Pat. No. 4,802,987 teaches the selective removal of aromatic hydrocarbons from feed streams containing a mixture of aromatic and aliphatic hydrocarbons by selectively permeating the aromatics in the feed under pervaporation conditions through a regenerated cellulose or cellulose acetate membrane having a dry thickness of about 10 to 25 $\mu$ and a molecular weight cut off of from about 10,000 to 50,000 which membrane is impregnated with from 10 to 25 wt% polyethylene glycol having a molecular weight in the range of about 600–14,000. In the text at column 1, line 35 the patent suggests that the process "can selectively remove aromatics from these mixed feed streams to reduce the severity of solvent extraction or eliminate distillation." This can be taken to mean that should aromatics be taken from a hydrocarbon feed stock by a prior membrane step then it would be possible to "back-off" on the extraction process and operate the latter at reduced severity (e.g. lower treat rate and/or lower temperature) to achieve the same raffinate product quality/-quantity. It would be presumed that if some of the aromatics are first removed by membranes then less would have to be removed by the subsequent extraction step and such step could be run at reduced severity. Nothing in the reference suggests that solvent extracting a retentate from the membrane separation of a distillate under standard extraction conditions would result in an increased yield of higher quality raffinate as compared to simply the extraction, under similar conditions, of the same distillate. At best, it can be speculated that extracting the retentate at lower severity as suggested in U.S. Pat. No. 4,802,987 might achieve a yield advantage but this might have been accompanied by some raffinate quality decrease. That both quantity and quality of the raffinate obtained is improved in an unexpected synergy of the 2-step process of the present invention.

SUMMARY OF THE INVENTION

The yield, raffinate product quality, and throughput of selective aromatics solvent extraction processes practiced on hydrocarbon feeds are improved by subjecting the feed first to a membrane separation process which selectively permeates aromatics through the membrane producing an aromatics rich permeate and a retentate of reduced aromatics content then solvent extracting the retentate to yield a raffinate. The yield, quality and throughput of the raffinate are higher than obtained by the practice of the selective aromatics solvent extraction process on the same hydrocarbon feed which had not been first subjected to membrane separation, under the same extraction conditions.

DESCRIPTION OF THE PREFERRED EMBODIMENTS

Figure 1:
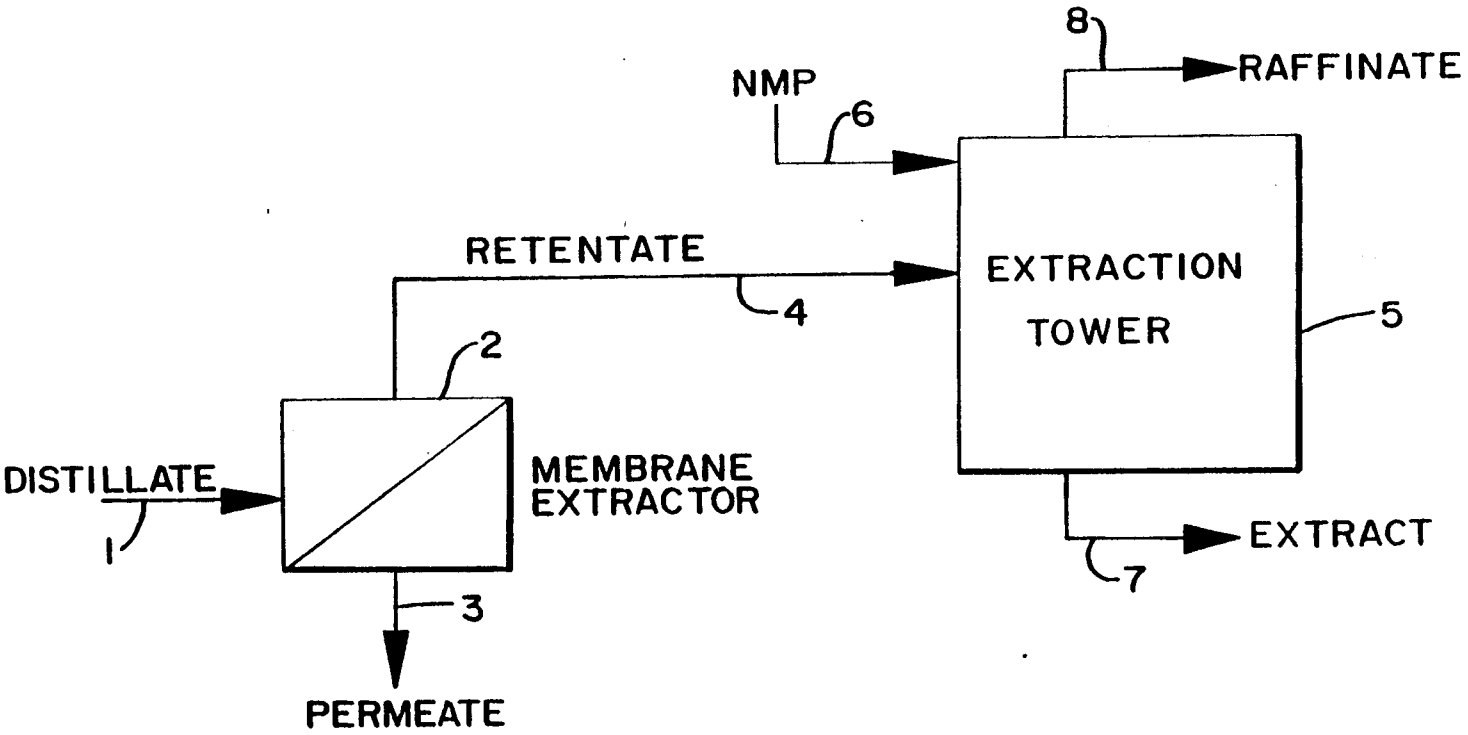
FIG. 1 is a schematic of the integrated process of the present invention showing selective membrane separation of aromatics from a hydrocarbon feed and selective aromatics solvent extraction of the retentate obtained from the membrane process to produce enhanced yield and throughput of raffinate.

The yield quality and throughput of raffinate produced by the selective aromatics solvent extraction of hydrocarbons is improved by the process of subjecting the hydrocarbon feed to a selective membrane separation process to remove aromatic hydrocarbons from the feed yielding an aromatics rich permeate and a retentate of decreased aromatics content and then subjecting the retentate to the selective aromatics solvent extraction process. By practice of this process sequence, that is, membrane separation followed by solvent extraction of the membrane retentate the solvent extraction process produces an increased yield of raffinate of higher quality at higher throughput as compared to the practice of the selective aromatics solvent extraction process on the original hydrocarbon feed under the same extraction conditions (i.e., extraction severity).

The process of the present invention may be practiced on any aromatics containing hydrocarbon feed stream from which it is desired to remove the aromatics and produce a saturates rich raffinate. The hydrocarbon stream can be any light to heavy material coming from any source, natural petroleum or synthetic stream such as coal liquefaction products, tar sands, or shale oil products. The hydrocarbon feed will be any light to heavy fraction, usually a distillate fraction boiling in the about 320° to about 1100° F. range. This embraces the jet and kerosene fraction (320°-500° .F) through diesel (400°-650° F.) into lube (600° to 1100° F.) including Bright Stock.

The membrane separation zone can include the system described in U.S. Pat. No. 3,370,102 which separates aromatics from saturates in a wide variety of feed mixtures including various petroleum fractions, naphthas, oils, and other hydrocarbon mixtures. Expressly recited in '102 is the separation of aromatics from kerosene. The process produces a permeate stream and a retentate stream and employs a sweep liquid to remove the permeate from the face of the membrane to thereby maintain the concentration gradient driving force. U.S. Pat. No. 2,958,656 teaches the separation of hydrocarbons by type i.e. aromatics, unsaturated, saturated by permeating a portion of the mixture through a non-porous cellulose ether membrane and removing permeate from the permeate side of the membrane using a sweep gas or liquid. U.S. Pat. No. 2,930,754 teaches a method for separating hydrocarbons by type, i.e. aromatics and/or olefins from gasoline boiling range mixtures by the selective permeation of the aromatics through certain cellulose ester non-porous membranes. The permeated hydrocarbons are continuously removed from the permeate zone using a sweep gas or liquid. U.S. Pat. No. 4,115,465 teaches the use of polyurethane membranes to selectively separate aromatics from saturates via pervaporation.

U.S. Pat. No. 4,914,064 teaches polyurea/urethane membranes and their use for the separation of aromatics from non-aromatic hydrocarbon. The membrane is characterized by possessing a urea index of at least 20% but less than 100%, an aromatic carbon content of at least 15 mole %, a functional group density of at least about 10 per 1000 grams of polymer and a C=O/NH ratio of less than about 8.

In U.S. Pat. No. 4,861,628, a thin film composite membrane constituting a thin layer of polyurea/urethane polymer deposited on a thick-permeable support layer is produced by preparing a fine dispersion of discrete polyurea/urethane polymer particles in a solvent which does not react with or dissolve the selected thick-permeable support layer. The dispersion is contacted with only one face of the support layer. The solvent is permitted to evaporate and the composite membrane results. The support layer will generally have pores ranging from 0.005 to 0.5 microns. Typical support include polyamide, polyimide, polyacrylonitrile, polybenzimidazole, teflon, cellulose acetate and polyolefins such as polyethylene and polypropylene.

Thin film composites can also be produced from solutions, as taught in U.S. Pat. No. 4,837,054. In that procedure the polyurea/urethane copolymer is prepared in a solution consisting of (a) an aprotic solvent such as dimethylformamide (DMF) (b) a cyclic ether such as dioxane, (c) cellosolve acetate or methyl cellosolve and (d) a wetting agent such as crotyl alcohol to produce a casting solution which is then deposited as a thin film onto a microporous support, excess solution permitted to drain from the support, and the solvent permitted to evaporate leaving a thin active layer on the support backing. Supports which are insoluble in the solvents used to produce the casting solution are e.g. polyolefin (e.g. polyethylene and polypropylene) and teflon. The support possesses a molecular weight cut-off in the range of about 10,000 to 100,000. The solvent is used in a parts per hundred ratio of a/b/c/d in the range about 3-27/94-33/2-33/1-7. The polymer concentration in the solution can range up to about 40 parts or more polymer in the solution based on 100 parts solvent. Preferred polymer concentration is in the range 0.5 to 20 parts polymer, preferably 1-10 parts polymer, more preferably 1-5 parts polymer per 100 parts solvent.

The solvent is permitted to evaporate with the application of heat if needed to drive off the solvent. If a solvent of a low enough vapor pressure is employed the application of heat can be omitted.

The preparation of an anisotropic polyurea/urethane membrane is the subject of U.S. Pat. No. 4,828,773 and U.S. Pat. No. 4,879,044. The preferred anisotropic membrane is produced by preparing a casting solution of the polyurea/urethane copolymer having the above recited characteristics in a solvent containing less than about 5 vol.% non-solvent, preferably about 0 vol.% non-solvent, the preferred solvent being dimethylformamide, to produce a casting solution. A thin film of the casting solution is deposited on a support having a maximum pore size of less than about 20 microns (e.g. glass, metal, release paper, etc.), exposing the thin film on support to conditions of temperature and time such that the solvent vapor pressure-time factor is about 1000 mm Hg-min and less, preferably about 200 mm Hg-min and less, and quenching the membrane film in a non-solvent such as water yielding the desired anisotropic membrane. The anisotropic membrane produced possesses a three layer structure, a thin dense layer generated at the film/support interface, a thin non-continuous skin which is generated at the membrane-quench solvent interface and an open, porous structure which exists between the aforementioned thin dense layer and thin non-continuous skin layer.

Polyurethane imides are produced by endcapping a polyol selected from those recited above with a polyisocyanate also selected from those recited above followed by chain extending by reaction with a polyanhydride which produces the imide directly or with di or poly carboxylic acids which produce amic acid groups which can be chemically or thermally condensed/cyclized to the imide. Aliphatic and cycloaliphatic di- and polyisocyanates can be used as can be mixtures of aliphatic, cycloaliphatic, aralkyl and aromatic polyisocyanates. Polyurethane imide membranes and their use for aromatics/non-aromatics separation are the subject of U.S. Pat. No. 4,929,358.

Isocyanurate crosslinked polyurethane membranes and their use for the separation of aromatics from non-aromatics is the subject of U.S. Pat. No. 4,929,357. The isocyanurate crosslinked polyurethane membrane is produced by preparing an end capped isocyanate pre-polymer of polyurethane by reacting dihydroxy or polyhydroxy compounds (e.g. polyethers or polyesters) with aliphatic, alkylaromatic or aromatic di or poly isocyanates and trimerizing this isocyanate end-capped polyurethane using a standard trimerization catalyst such as N,N',N''-tris(dimethylaminopropyl)-shexahydrotriazine, Sodium ethoxide, Potassium octoate, N-Hydroxypropyl-trimethylammonium-2-ethylhexanote, Potassium 2-ethylhexanoate, Trialkylphosphines, 2,4,6-Tris(dimethylaminomethyl)phenol and mixtures thereof. Using these catalyst yields a mixture which slowly thickens due to crosslinking accounted for by the formation of isocyanurate crosslinked rings. Before this mixture becomes too thick, it is deposited as a thin film on an appropriate substrate and permitted to fully gel, after which the membrane coat is treated to complete the formation of isocyanurate crosslinked polyurethane. This final treat can constitute no more than waiting a sufficiently long time to be certain that trimerization is complete. More likely this final treat will involve various degrees of drying followed, preferably, by heating to complete the trimerization to the isocyanurate crosslinked polyurethane.

U.S. Pat. No. 4,962,271 teaches the selective separation of multi-ring aromatic hydrocarbons from distillates by perstraction. The multi-ring aromatics are characterized by having less than 75 mole % aromatic carbon content. Perstractive separation is through any selective membrane, preferably the aforesaid polyurea-/urethane, polyurethane imides or polyurethane isocyanurates.

The previously described membranes and processes are all useful for separating aromatics from non-aromatics/saturates mixtures from a variety of feeds. It is herein envisioned that such membranes and processes can be practiced on the hydrocarbon feed to produce an aromatics rich permeate and a saturates rich retentate and that, in accordance with the teaching of the present specification, the retentate can be subjected to the selective aromatics extraction process to produce a raffinate of increased yield at increased throughput as compared to an extraction process practiced on the original hydrocarbon feed.

A preferred membrane separation procedure, however, is the subject of copending application U.S. Ser. No. 622,706 filed even date herewith in the names of Chen and Sweet. In that specification it is taught that multi-ring aromatics, i.e. 2+ ring aromatics containing alkyl and heteroatom alkyl side chains and even heteroatom containing multi-ring aromatics such as benzo thiophene and dibenzo thiophene and quinoline can be selectively separated from a hydrocarbon feed such as distillate or even a solvent extraction extract oil using a procedure involving passing the hydrocarbon feed along one face of a non-selective, porous, partition barrier membrane while simultaneous passing, preferably in countercurrent flow, along the opposite face of said membrane a selective extraction solvent such as phenol, furfural, sulfolane, N-methyl 2-pyrrolidone, acetonitrile, or an aliphatic polyamine such as ethylene diamine diethylene triamine, triethylene tetramine, etc. and mixtures thereof. The multi-ring aromatic selectively permeates through the membrane in response to the selective extraction solvent yielding a retentate rich in saturates and 1-ring aromatics and a permeate rich in multi-ring aromatics.

The process makes use of a highly porous partition barrier. The barrier may be an ultrafiltration membrane made of ceramic, sintered glass or metal or of a polymeric material such as polyethylene, polypropylene, teflon, cellulose, nylon etc. and generally has a pore size in the range 100 to 5000Å. The membrane is, preferably, hydrophobic in nature.

In the process the hydrocarbon feed and the extraction solvent can be contacted at any temperature so long as both the feed and solvent are in the liquid state. Because the separation process is driven by the affinity of the extraction solvent for the aromatic molecules, the process can be run at atmospheric pressure. Indeed, because of the high porosity of the membrane partition barrier the existence of a pressure differential, either by the direct application of pressure on the feed or solvent side or the creation of a vacuum on either side is undesirable as such a pressure differential would physically force feed or solvent across the barrier and thus defeat its purpose.

In the present process the retentate recovered from any of these membrane separation processes is fed to an aromatics selective solvent extract zone wherein the feed (i.e. the retentate) is contacted with an aromatics selective solvent under typical normal severity conditions to produce an extract enriched in aromatics and a raffinate of still further decreased aromatics content. The conditions employed in the extraction zone in this process are the same conditions which would have been used to solvent extract the original hydrocarbon feed had no membrane separation of aromatics from the feed been practiced.

Selective aromatics extraction solvents which may be used in the solvent extraction process include any of the well known materials such as phenol, furfural, sulfolane, and n-methyl-2-pyrrolidone (NMP). Typical extraction conditions range from a temperature of 50° to 120° C. and a solvent treat of 80 to 400 liquid volume percent (LV%). NMP solvent can contain 0 to 5% water while phenol solvent can contain 0 to 10% water.

The present invention is illustrated in FIG. 1.

A lube or other hydrocarbon fraction distillate is fed via line (1) to a membrane separation zone (2) wherein it is divided into an aromatics rich permeate recovered via line (3) and a retentate of decreased aromatics content recovered via line (4). This retentate is fed via line (4) to an aromatics selective solvent extraction zone (5) wherein it is countercurrently contacted with an aromatics selective solvent such as NMP introduced via line (6). An extract of enriched aromatics content is recovered via line (7) while a raffinate of decreased aromatics content is recovered via line (8). The process of the present specification produces a yield credit of about 15% as compared to a solvent extraction process practiced lube distillate which had not been first subjected to the membrane separation step.

EXAMPLE

To illustrate the effectiveness of the integrated process, a 100 neutral lube distillate was procured and was then pre-extracted by membrane extraction. Ethylenediamine was used as the extraction solvent although other solvents such as DMSO and sulfolane could also have been used. A 0.2 μm pore size micro-porous teflon membrane was used to physically partition the extraction solvent from the feed although other micro-porous membranes such as nylon 6,6 from Pall or polypropylene from Celanese such as Celgard 2400 or Celgard 2500 could also have been used. As can be seen from Table 1, the mass spec. completed on the retentante, the permeate and the distillate feed show that the desired pre-extraction of the aromatics from the distillate feed was successfully accomplished by membrane extraction. The permeate is of 76.3 LV% aromatics while the distillate feed was of about 37.4 LV% aromatics giving a retentate aromatics concentration of 25.5 LV%. The retentate yield was 84.9 wt% (i.e., 15.1 wt% permeate yield).

After the distillate feed was membrane pre-extracted, the retentate was then solvent extracted with N-methyl pyrrolidone containing 0.4% water to determine its solvent extraction yield (Table 2). At 60° C. and 340% batch solvent treat, it was found that a batch raffinate yield of 60.1 wt% was obtained. From this, it can be calculated that an overall raffinate yield of 51.0 wt% (84.9 wt% retentate yield X 60.1 wt% raffinate yield) was achieved by the integrated membrane/solvent extraction process.

As shown in Table 2, direct solvent extraction of the raw 100N distillate under similar conditions as those used for the retentate, gave a 49.1 wt% raffinate yield. Thus, the overall yield of the integrated process, 51.0 wt%, is 1.9 wt% higher than was obtained by solvent extraction alone. The throughput of the integrated process would also be increased by about 15% (i.e. the amount permeated by the membrane) relative to the throughput of the process using the solvent extraction tower alone.

In this specification, although membrane extraction was utilized, it can be expected that other aromatics/-saturates membrane separation processes such as perstraction could also be used to achieve the desired pre-extraction of lube distillated. Also, although data on only a 100 neutral distillate are shown, it is expected that the benefits proposed herein will be applicable to other oil grades and other refinery streams where aromatics/saturates separation are needed.

TABLE 1

| MEMBRANE PRE-EXTRACTION STEP | | | |
|---|---|---|---|
| Feed | 100 N Lube Distillate | | |
| Membrane Extraction | | | |
| Membrane | Teflon, 0.2 μm pore size | | |
| Solvent | Ethylenediamine | | |
| Temperature, °C. | 70 | | |
| Flux, kg/m²/day | 8.9 | | |
| Permeate Yield, Wt % | 15.1 | | |
| Retentate Yield, Wt % | 84.9 | | |
| Compositions, LV % (1) | Feed | Permeate | Retentate |
| Saturates | 62.6 | 23.7 | 74.5 |
| Aromatics | 37.4 | 76.3 | 25.5 |
| 1 − R Arom | 10.5 | 16.9 | 9.1 |
| 2 + R Arom | 26.9 | 59.4 | 16.4 |

(1) Determined by mass spec.

TABLE 2

| SOLVENT EXTRACTION STEP(1) | | |
|---|---|---|
| | Retentate | 100 N Lube Distillate |
| Feed | | |
| Refractive Index @75° C. | 1.4606 | 1,4720 |
| Raffinate | | |
| Batch Yield, Wt % | 60.1 | 49.1 |
| Raffinate RI @75° C. | 1.4446 | 1.4449 |
| Raffinate VI (2) | 92.6 | 90.5 |
| Yield based on Distillate wt % | 51.0 | 49.1 |
| Extract | | |
| Batch Yield, Wt % | 39.9 | 50.9 |
| Extract RI @75° C. | 1.4849 | 1.4977 |

(1) NMP with 0.4 wt % water, 60° C., and 340 LV % batch treat rate.
(2) Viscosity Index of dewaxed raffinate oil.

What is claimed is:

1. A method for improving the yield, increasing the viscosity index, and improving the throughput of raffinate produced by the selective aromatics solvent extraction of hydrocarbon feeds, said method comprising subjecting the hydrocarbon feed to a selective membrane separation process to remove aromatic hydrocarbons from the feed yielding an aromatics rich permeat and an aromatics lean retentate as compared to the hydrocarbon feed and subjecting the retentate to a selective aromatics solvent extraction process operating at extraction conditions appropriate to solvent extract the hydrocarbon feed in the absence of a membrane separation step, said conditions being a temperature of from 50° C. to 120° C. and a solvent treat of from 80 liquid volume percent LV% to 400 LV% thereby producing an increased yield of increased viscosity index, reduced aromatics content raffinate at increased throughput as compared to the yield, viscosity index, aromatics content, and raffinate throughput of the selective aromatics solvent extraction process on the hydrocarbon feed in the absence of any membrane separation step under the same extraction conditions.

2. The method of claim 1 wherein the hydrocarbon carbon feed is selected from hydrocarbons boiling in the about 320° to about 1100° F. range.

3. The method of claim 1 wherein the membrane separation process is practiced by passing the hydrocarbon feed along one face of a non-selective, porous, partition barrier membrane while simultaneously passing along the opposite face of said membrane a selective extraction solvent whereby the aromatic hydrocarbons selectively permeate through the porous membrane barrier in response to the selective extraction solvent yielding a permeate rich in multi-ring aromatic hydrocarbons and a retentate rich in saturates and 1-ring aromatic hydrocarbons.

4. The method of claim 3 wherein the non-selective, porous, partition barrier has a pore size in the range 100° to 5000Å.

5. The method of claim 4 wherein the non-selective porous, partition barrier is selected from ultrafiltration membranes made of polyethylene, polypropylene, teflon, cellulose or nylon.

6. The method of claim 3, 4 or 5 wherein the selective extraction solvent passed along the opposite face of the porous, non-selective partition barrier comprises phenol, furfural, sulfolane, N-methyl-2-pyrrolidone, acetonitrile and aliphatic polyamines.

7. The method of claim 6 wherein the selective extraction solvent is passed countercurrently along the membrane face opposite to the face along which the hydrocarbon feed is passed.

* * * * *